US011421830B2

(12) United States Patent
Moon et al.

(10) Patent No.: US 11,421,830 B2
(45) Date of Patent: Aug. 23, 2022

(54) LENS-FITTED RETROFIT LED LAMP SYSTEM

(71) Applicants: Brian Robert Moon, Woodbridge, VA (US); John W. Luhrs, Marietta, GA (US)

(72) Inventors: Brian Robert Moon, Woodbridge, VA (US); John W. Luhrs, Marietta, GA (US)

( * ) Notice: Subject to any disclaimer, the term of this patent is extended or adjusted under 35 U.S.C. 154(b) by 0 days.

(21) Appl. No.: 16/953,683

(22) Filed: Nov. 20, 2020

(65) Prior Publication Data

US 2021/0156524 A1 May 27, 2021

Related U.S. Application Data

(60) Provisional application No. 62/938,496, filed on Nov. 21, 2019.

(51) Int. Cl.

| | |
|---|---|
| ***F21K 9/233*** | (2016.01) |
| ***F21K 9/69*** | (2016.01) |
| ***F21V 17/16*** | (2006.01) |
| ***F21V 17/06*** | (2006.01) |
| *F21Y 115/10* | (2016.01) |
| *F21W 131/406* | (2006.01) |

(52) U.S. Cl.

CPC ..... *F21K 9/233* (2016.08); *F21K 9/69* (2016.08); *F21V 17/06* (2013.01); *F21V 17/16* (2013.01); *F21W 2131/406* (2013.01); *F21Y 2115/10* (2016.08)

(58) Field of Classification Search

CPC .... F21K 9/23; F21K 9/69; F21B 17/06; F21B 17/16

See application file for complete search history.

(56) References Cited

U.S. PATENT DOCUMENTS

| | | | | |
|---|---|---|---|---|
| 5,404,869 A * | 4/1995 | Parkyn, Jr. | ..... | G02B 27/09 136/246 |
| 2004/0042208 A1* | 3/2004 | Wu | ..... | F21V 13/04 362/329 |
| 2007/0139921 A1* | 6/2007 | Wu | ..... | F21V 23/02 362/240 |
| 2014/0002676 A1* | 1/2014 | Ning | ..... | G02B 7/003 235/375 |

* cited by examiner

*Primary Examiner* — Rajarshi Chakraborty
*Assistant Examiner* — Nathaniel J Lee
(74) *Attorney, Agent, or Firm* — Thomas Horstemeyer, LLP

(57) ABSTRACT

The disclosure describes systems and methods for retrofitting a light fixture using a lens-fitted retrofit assembly. The lens-fitted retrofit assembly is attached anterior to the LED lamp engine. A lens-fitted retaining adapter of the lens-fitted retrofit assembly includes at least one curved portion that matches a radius of curvature of a lens holder of the light fixture. The lens-fitted retrofit assembly is held into the light fixture based at least in part on the lens-fitted retaining adapter and the lens holder.

20 Claims, 6 Drawing Sheets

LENS-FITTED RETROFIT LED LAMP SYSTEM

BACKGROUND

Light emitting diode (LED) lamps are only good for the intended socket they are designed for. Tungsten lamps have this same issue. A reconfigurable Tungsten based parabolic aluminized reflector (PAR) stage lighting fixture or other PAR lighting fixtures can have a housing with a base connector and an integrated reflector and lens is generally only be able to function with a lighting source designed to be used with that particular system. Such a stage lighting PAR fixture would not be compatible with high-power LED lamps without extensive alterations or modifications.

In addition, high-power LED lamps are designed currently to go into a single lamp socket without having the means to fit into an existing lamp fixture. A complete redesign of the lamp or fixture would be required. In addition, existing retrofits can require substantial disassembly of the lamp fixture. Some stage lighting PAR fixtures require disassembly of the fixture and removal of the original reflector. This is inefficient in time and can be difficult or impossible for end users to complete without hiring electricians or other electrical installation professionals. As a result, there is a need for efficient LED retrofit lighting that is easy to install for end users.

BRIEF DESCRIPTION OF THE DRAWINGS

Many aspects of the present disclosure are better understood with reference to the following drawings. The components in the drawings are not necessarily drawn to scale, with emphasis instead being placed upon clearly illustrating the principles of the disclosure. In the drawings, like reference numerals designate corresponding parts throughout the several views.

DETAILED DESCRIPTION

Figure 1:
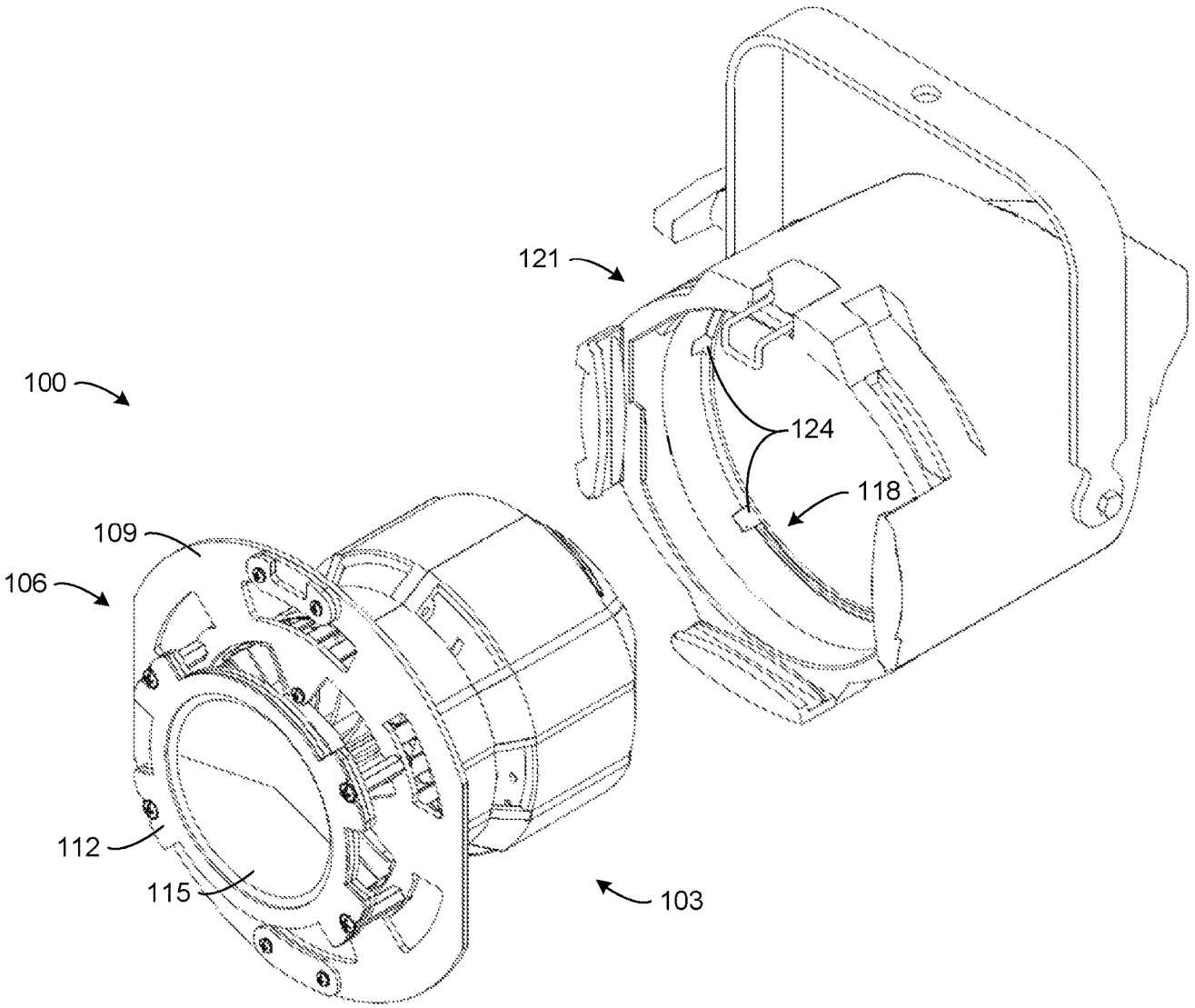
FIG. 1 is a drawing that illustrates an isometric view of an example retrofit LED lamp system, according to various embodiments of the present disclosure.

The present disclosure relates to systems and method for retrofitting parabolic aluminized reflector (PAR) fixtures and other light fixtures using lens-fitted retrofit system. An LED lamp engine and lens-fitted retaining adapter is configured to quickly retrofit into reconfigurable Tungsten based PAR fixtures and other light fixtures, in some cases without modification of the existing fixture.

A lens-fitted retaining adapter can be mechanically attached to the LED lamp engine, and can securely mount within a lens holder of the original light fixture. To this end, the lens-fitted retaining adapter can include at least one contact point about its periphery that matches a radius of curvature of a lens and/or lens holder of the original light fixture.

Existing retrofits for PAR fixtures are inefficient in both time and effort, as well as inefficient in energy expenditure. For example, some retrofits are inefficient in terms of lumens per Watt Efficacy as compared to LED lighting. They can also be difficult to install, requiring disassembly and reassembly after removal of the entire reflector from the fixture, and other complex holding mounting techniques. Others can rely on mounting to an electrical socket or connector.

The disclosed lens-fitted retrofit system can enable toolless installation in compared to other retrofit systems. Even manufacturer-provided retrofits can require stud adapters that require tool-based installation. By contrast, the lens-fitted retrofit system can quickly and securely snap into the lens holder without additional support. The electrical components can also be adapted for toolless installation based on a toolless lamp base adapter that can be configured for toolless electrical connection to the original (or custom) lamp back cap, and toolless electrical connection to the LED engine of the lens-fitted retrofit system.

An entirely new fixture body can also be required for some existing modular lamp engines to go into a particular PAR fixture. These solutions can require the end user to hire electrician to install such units, especially in the case of a lamp wire tail being hardwired into an electrical junction box of sorts in order to meet emergency electrical requirements. Further, other retrofit lighting does not match the original light's optical parameters such as beam angle, beam intensity, and other optical parameters. However, the present disclosure solves these by providing a modular LED lamp engine and lens-fitted retaining adapter for parabolic aluminized reflector (PAR) fixtures that does not require extensive disassembly of the fixture housing, does not require reflector removal, and matches the original light's optical parameters, while providing greater energy efficiency.

The disclosed modular LED lamp engine can include methods of control including wireless DMX, engine-specific phase dimming or any other wireless control protocol or wired Low voltage control protocol (DMX512 or others), including 0-10V control, Casambi wireless, Bluetooth, WiFi, and other control protocols.

The disclosed modular LED lamp engine can utilize a set of multiple lenses, multiple base LED lamp engines at multiple different Light Emitting Surface (LES), at multiple different wattages and different lumen Densities. There can be three or more lenses, base LED lamp engines, LES chips, wattages, and lumen densities. This can create solutions for retrofitting multiple different types of PAR fixtures from wide variety of manufacturers, and other theatre, architectural, stage, and other PAR lighting fixtures.

The disclosed modular LED lamp engine can utilize the same (or different) set of Total Internal Reflection (TIR) optics which uses a combination of reflection as well as refracting of the light beam for collimation and beam spread. By using same set of optics along with different sized LES LED chips at varying lumen densities the disclosed modular LED lamp engine retrofit can be configured so that it closely mimics and matches the actual original beam spread and delivered light at throw distance as the original lighting source, while providing greater efficiency than the original lighting source and preventing wasted light by having too wide of a field.

With smaller LES and higher lumen concentration in terms of lumens per mm squared while using the same optical lens characteristic of the original lens, the disclosed modular LED lamp engine can also create a tighter more concentrated beam of light, allowing for a higher candela in terms of delivered light.

A lens-fitted retaining adapter (e.g. a ring or partially ring-shaped component that mechanically holds the entire LED lamp engine assembly in place inside the original fixture) can be designed in such a way that they can be easily changeable. The lens-fitted retaining adapter can be machined to fit the exact requirements in terms of method of adaption to a particular fixture or application. For example, an original lighting fixture can include a lens holder. The lens holder can include a ring slot or another shaped slot, groove, or indenture that holds a glass, poly, or other lens of the original fixture. The lens holder can also include a lens retaining spring or retaining element. The lens-fitted retaining adapter can be configured to fit securely into a lens holder for a lens of the original PAR lighting fixture.

The lens-fitted retaining adapter can be mechanically attached to the LED lamp engine, and can securely mount within a lens holder of the original light fixture. To this end, the lens-fitted retaining adapter can include at least one contact point about its periphery that matches a radius of curvature of a lens and/or lens holder of the original light fixture. For example, the lens-fitted retaining adapter can include a single ring shaped portion forming a single curve that forms a single contact point about the entire periphery of the lens-fitted retaining adapter. The lens-fitted retaining adapter can also have a shape that incorporates two curved portions that form two contact points opposite each other, in order to securely attach into the lens holder of the original fixture. Any number of curved portions can be included in the shape of the lens-fitted retaining adapter.

The lens holder can include a circular or otherwise lens-shaped recess that includes lens holding elements. Lens holding elements can include a lens holding clip, which can include one or more spring clip, mechanical interference slip-over clip, or other type of clip, and/or one or more lens holding ridges. The lens holding elements can secure the original lens so that it does not rotate while being held in the lens holder or lens holder assembly.

The lens-fitted retaining adapter can also include one or more lens retaining protrusions. A lens retaining protrusion can include a thicker portion of the lens-fitted retaining adapter that is designed to hold the lens-fitted or lens-matching retrofit assembly more firmly and securely into the lens holder. In some cases, lens retaining protrusions can be incorporated humped portions on the anterior of the lens-fitted retaining adapter. In other cases, lens retaining protrusions can be attached to an anterior of the lens-fitted retaining adapter using screws, rivets, epoxy, glue or another attachment method. Lens retaining protrusions can be included to match the locations of the lens holding elements of the original lens holder. Lens retaining protrusions can be incorporated along the curved portion or portions of the lens-fitted retaining adapter, and the curved portions can also be included to match the locations of the lens holding elements of the original lens holder or lens holder assembly, including a spring clip location and one or more ridge location.

Lens retaining protrusions can also include rotation stops that prevent the lens-fitted retaining adapter from rotating away from the matching lens holding elements. In some cases, screws, rivets, bolts, or other mechanical attachments between the lens retaining protrusion and the lens-fitted retaining adapter can form the rotation stops of the lens retaining protrusion. In other cases, the rotation stops can include the sidewalls of a notch of a notched lens retaining protrusion. A notched lens retaining protrusion can include a raised and notched component that connects to, or is incorporated into, the lens retaining protrusion. The notch of the notched lens retaining protrusion can be sized to accept a lens holding clip and/or a lens holding ridge, and can prevent rotation of the lens-fitted retrofit assembly. Accordingly, the modular LED lamp engine and lens-fitted retaining adapter can replace the lens and lighting source of a PAR lighting fixture.

The lens-fitted retrofit assembly can include an accessory retainer, which can be mechanically connected anterior or posterior to the lens-fitted retaining adapter. The accessory retainer can include magnetic or mechanical retaining elements that securely accept an accessory and hold it against a retaining backplate. For example, a magnetic accessory retainer can include a magnetic or ferromagnetic metal backplate that magnetically connects to a magnetic or ferromagnetic metal front-plate. In other cases, a mechanical accessory retainer can include a mechanically connected backplate that mechanically connects to a front-plate. Mechanical accessory retainers can also include spring clips, mechanical latches or a slip-in-slot type retainers for the light shaping diffusion sheets and gel (colored transparent filters). Components of a mechanical accessory retainer can include plastic, metal, fiberglass, and other appropriate materials.

The accessory retainer of the lens-fitted retrofit assembly can hold an accessory such as a lens, gel, or light-shaping diffusion that substantially matches the original fixture light configuration, including the lens gel, and diffusion. In other cases, the lens-fitted retrofit assembly can be configured with any desirable configuration. Since the original lens cannot be used when the lens-fitted retrofit assembly is held by the original lens holder, it can be desirable to include the accessory retainer to maintain the option of using a lens along with the new LED lamp engine. The components of the lens-fitted retrofit assembly can include molded, machined, and solid injection-molded assemblies that include lens retaining protrusions as separate or integrated components.

The accessory retainer for the gel or Light Shaping diffusion can also be included because in some fixtures, the air space or other space inside the unit is very small and therefore using an existing accessory holder of the fixture to put in gel or light shaping diffusion can reduce air flow dramatically to the retrofit, therefore not allowing it to be efficiently cooled. The disclosed modular LED lamp engine and retrofit system can be passively cooled using passive airflow, heat sinks, and other passive components and/or actively cooled using fans and other active cooling components.

The following provides an example method or steps that can be followed to install the lens-fitted retrofit assembly and modular LED lamp engine, for example, into PAR fixtures that include a separate lens and light source.

- Remove Front Lens from original fixture
- Remove back cap and remove Lamp from Back Cap
- Install Desired lens-fitted retrofit assembly by securing the lens-fitted retaining adapter of original fixture's lens holder where the original lens was previously installed. Line up the lens retainer clip with the appropriate retaining protrusion (e.g., a notched retaining protrusion) and snap in the lens-fitted retaining adapter of the lens-fitted retrofit assembly.
- Plug in lamp base adapter into existing lamp cap
- Plug other end of lamp base adapter to back of modular LED lamp engine base plate.

Place desired lens on the accessory retainer backplate and hold in place using the accessory retaining front-plate. A color filter, gel, or beam-shaping film such as a holographic diffuser film or diffusion film can also be used with the accessory holder.

The following provides an example method or steps that can be followed to install the lens-fitted retrofit system into lighting fixtures that include a lens and light source-integrated lens assembly design and a spring ring (circular, semicircular, etc) or spring lens retainer that sits in front of the original lens or lens assembly as part of the lens holder.

Remove spring lens retainer ring for Lens and Lamp assembly from original fixture Unplug lamp porcelain from top of Lens and Lamp assembly Install Desired lens-fitted retrofit assembly into the mounting edge where Lens and Lamp assembly was previously installed. Reinstall spring Lens Retainer over top of modular LED lamp engine Base Plate.

Plug in lamp base adapter into existing lamp porcelain.

Plug other end of lamp base adapter to back of lens-fitted retrofit assembly.

Place desired lens on the accessory retainer backplate and hold in place using the accessory retaining front-plate. A color filter, gel, or beam-shaping film such as a holographic diffuser film or diffusion film can also be used with the accessory holder.

A lens-fitted retaining adapter ring flange can include a circular or substantially circular circumference with a radius or diameter that matches the original lens. In other situations, the lens-fitted retaining adapter can match the dimensions of the original lens, which can be any shape. The lens-fitted retaining adapter can sit securely where the original lens once sat as the method of mounting. For example, in some cases the lens retaining elements of the original light fixture can include a spring lens retainer ring that sits in front of the lens of the original fixture. However, the spring lens retainer ring can also sit in front of the lens-fitted retrofit assembly to securely hold the lens-fitted retrofit assembly within the lens-shaped recess of the lens holder assembly of the original fixture.

The lens-fitted retaining adapter can include locking elements that secure the retrofit LED lamp system 100 in place and with a particular orientation. Once engine is plugged in and placed inside lens retaining ring, rotate entire engine in place until existing spring clips or other clips (which were previously used to retain glass lens) are aligned and locked into place on the locking elements for interlocking the retrofit LED lamp system 100 to the fixture.

Moving now to the figures, FIG. 1 shows an isometric view of a retrofit LED lamp system 100. The retrofit LED lamp system 100 can include an LED lamp engine 103 and a lens-fitted retrofit assembly 106.

The lens-fitted retrofit assembly 106 can include a lens-fitted retaining adapter 109 and a magnetic or other accessory retainer 112. In some cases, the accessory retainer can securely hold a Total Internal Reflection (TIR) Lens, a gel diffuser, another diffuser, another type of lens, or another accessory 115. The retrofit LED lamp system 100 can fit securely into a lens holder 118 of an existing or original lighting fixture 121.

The lens-fitted retaining adapter 109 can be mechanically attached anterior to the LED lamp engine 103, and can securely mount within a lens holder 118 of the original light fixture 121. The lens-fitted retaining adapter 109 can also have a shape that incorporates two curved portions that form two contact points opposite each other, in order to securely attach into the lens holder of the original fixture. Any number of curved portions can be included in the shape of the lens-fitted retaining adapter.

The accessory retainer 112 can be mechanically connected to the lens-fitted retaining adapter 109. In the example shown, the accessory retainer 112 is connected anterior to the lens-fitted retaining adapter 109. The lens-fitted retaining adapter 109 can connect to a heatsink bracket or another connecting bracket of the LED lamp engine 103, for example, using a connecting element with connecting holes or slots that align with threaded or other connection points of a heatsink bracket or another type of connecting bracket of the LED lamp engine 103. In some cases, screws, press-fittings, rivets, glued dowels, glue, epoxy, and other components can facilitate the connection between the connecting holes of lens-fitted retaining adapter 109 and the connection points of the connecting bracket of the LED lamp engine 103.

The lens holder 118 can include a circular or otherwise lens-shaped recess that includes lens holding elements 124. Lens holding elements 124 can include a lens holding clip, which can include one or more spring clip, mechanical interference slip-over clip, or other type of clip, and/or one or more lens holding ridges. The lens holding elements can secure the original lens so that it does not rotate while being held in the lens holder.

Figure 2:
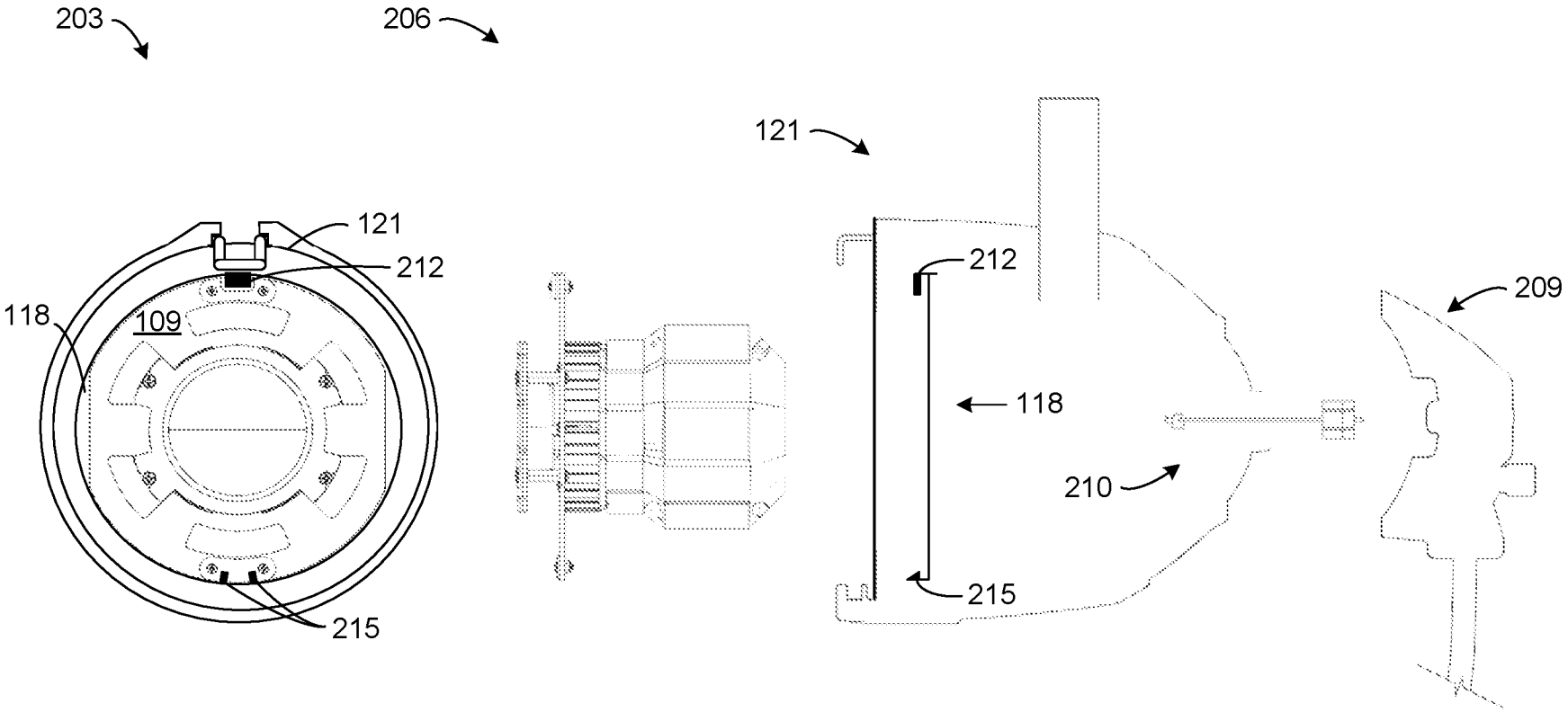
FIG. 2 is a drawing that illustrates front and side views of the retrofit LED lamp system shown in FIG. 1, according to various embodiments of the present disclosure.

FIG. 2 shows a front view 203 and a side view 206 of the retrofit LED lamp system 100. The side view 206 also includes an explosion side view of the original lighting fixture 121. The original lighting fixture 121 can include a back cap 209. The retrofit LED lamp system 100 can include a lamp base adapter 210.

The front view 203 shows the lens-fitted retaining adapter 109 in place within the lens holder 118 of the lighting fixture 121. The lens holder 118 can include a circular or lens shaped slot or recess, a lens holding clip 212, and lens holding ridges 215. The lens holding clip 212 can include one or more spring clip, mechanical interference slip-over clip, or other type of clip. In some cases the lens holding clip 212 can include a hinged clip. These lens holding elements 124 can secure the lens-fitted retaining adapter 109 in place so that it does not rotate while being held in the lens holder 118.

The lamp base adapter 210 can include a LED lamp engine connector that is matched to a power input of the LED lamp engine 103. The lamp base adapter 210 can also include a back cap or lamp base connector that is matched to a power output or lamp base of the back cap 209 of the original lighting fixture 121. The lamp base connector can include an HPL base socket connector, a proprietary socket connector, or another base connector. A flexible wiring can connect the lamp base connector and the LED engine connector of the lamp base adapter 210.

The base socket adapter 210 can be connected to the LED lamp engine, for example, using a connector on the LED lamp engine 103 that accepts wires of the wire tail connected to the base socket adapter 210. This LED lamp engine electrical connector can include a push-in connector that accepts the wires, a clamp-down or screw-down connector, or another user friendly connector that obviates the need for a junction box connection. The wired tail can allow for ease of adaptation to existing units, for example, by slipping through a lighting hole in the existing reflector and connecting to the LED lamp engine electrical connector. The solution provided by the retrofit LED lamp system 100 minimizes disassembly of the original fixture, and preserves the original aesthetic looks of the fixture housing. Alterations that remove the reflector can also affect the fixture housing and the aesthetic appeal of the original fixture. The lens-fitted retaining adapter can fit into an existing fixture's lens holder using the shown spring clip locking elements that are attached to the lens-fitted retaining adapter ring.

While the original lamp back cap 209 can be utilized, the retrofit LED lamp system 100 can also include a custom lamp back cap 209 that can include a standard or proprietary connector that matches the base socket adapter 210, and can replace the existing lamp back cap that houses the existing electrical wiring and socket. The custom lamp cap can attach to the existing fixture housing in a manner similar to the original lamp cap and can maintain the aesthetic of the original existing fixture. The custom lamp back cap 209 can be used in order to obviate use of a proprietary connector associated with a manufacturer of the original fixture. The custom lamp back cap 209 can also be used in order to replace the proprietary connector associated with a manufacturer of the fixture with a standardized connector, or a proprietary connector associated with retrofit LED lamp system 100.

Figure 3:
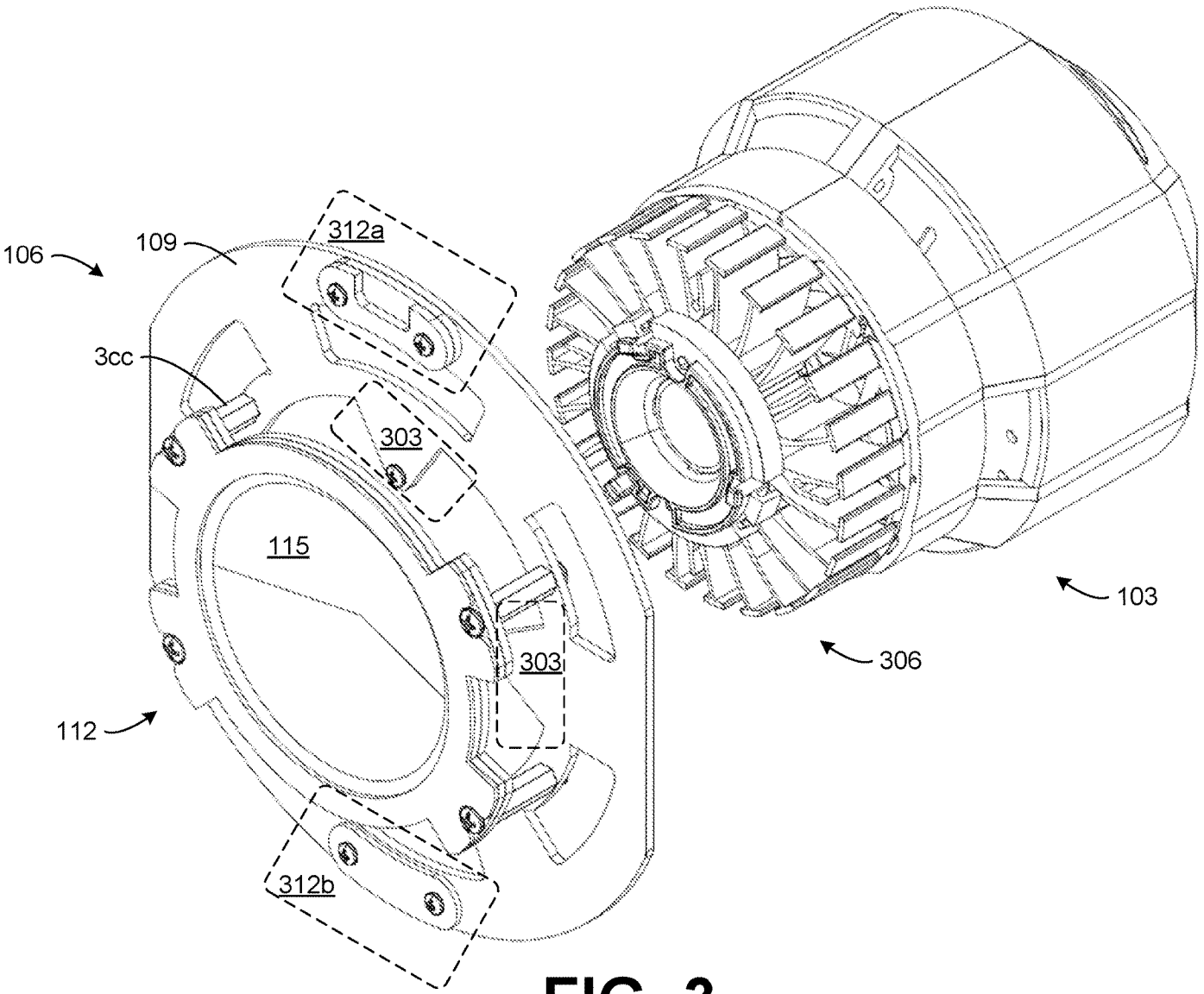
FIG. 3 is a drawing that illustrates an isometric view of a lens-fitted retrofit assembly and an LED lamp engine of the retrofit LED lamp system 100, according to various embodiments of the present disclosure.

FIG. 3 shows an isometric view of a lens-fitted retrofit assembly 106 and an LED lamp engine 103 of the retrofit LED lamp system, according to various embodiments of the present disclosure. The lens-fitted retrofit assembly 106 can include a lens-fitted retaining adapter 109 and a magnetic or other accessory retainer 112. The accessory retainer 112 can securely hold an accessory 115.

The lens-fitted retaining adapter 109 can be mechanically attached anterior to the LED lamp engine 103, and can securely mount within a lens holder 118 of the original light fixture 121. The accessory retainer 112 can be mechanically connected anterior or posterior to the lens-fitted retaining adapter 109. In the example shown, the accessory retainer 112 is designed to be connected anterior to the lens-fitted retaining adapter 109.

The lens-fitted retaining adapter 109 can include mounting elements 303. The mounting elements 303 can connect to a heatsink bracket 306 or another connecting bracket of the LED lamp engine 103. The mounting elements 303 can include holes, threaded holes, or slots that enable the lens-fitted retaining adapter 109 to be mounted to a connecting element with connecting holes or slots that align with threaded or other connection points of a heatsink bracket 306 or another type of connecting bracket of the LED lamp engine 103. In some cases, screws, press-fittings, rivets, glued dowels, glue, epoxy, and other components can facilitate the connection between the connecting holes of lens-fitted retaining adapter 109 and the connection points of the connecting bracket of the LED lamp engine 103. The mounting elements 303 can include protrusions about the periphery of an interior edge of the lens-fitted retaining adapter 109, which can be a shape of substantially flat metal, plastic, fiberglass, or other appropriate material as discussed.

The accessory retainer 112 can alternatively be mechanically connected posterior to the lens-fitted retaining adapter 109. In such an example, the accessory retainer 112 can include the connecting element that includes connecting holes or slots that align with threaded or other connection points of the heatsink bracket other type of connecting bracket of the LED lamp engine 103. In this example, the connecting element can include a protrusion about the periphery of the backplate of the accessory retainer 112, which can remain a shape of substantially flat metal, plastic, fiberglass, or other appropriate material.

The lens-fitted retaining adapter 109 can also include one or more lens retaining protrusions 312 (e.g., lens retaining protrusions 312*a* and 312*b*). A lens retaining protrusion 312 can include a thicker portion of the lens-fitted retaining adapter 109 that is designed to hold the lens-fitted retrofit assembly more firmly and securely into the lens holder. In some cases, lens retaining protrusions can include incorporated humped portions on the anterior of the lens-fitted retaining adapter. In other cases, lens retaining protrusions can include an additional layer of material such as metal, plastic, fiberglass, or other material attached to an anterior of the lens-fitted retaining adapter 109 using one or more of screws, rivets, epoxy, glue or another attachment. Lens retaining protrusions 312 can match the locations of the lens holding elements of a lens holder 212. Lens retaining protrusions 312 can be incorporated along the curved portion or portions of the lens-fitted retaining adapter 109, and the curved portions can also be included to match the locations of the lens holding elements of the original lens holder, including a spring clip location and one or more ridge location.

The lens-fitted retaining adapter 109 can have a shape that incorporates two curved portions that form two contact points opposite each other, in order to securely attach into the lens holder of the original fixture 121. Any number of curved portions can be included in the shape of the lens-fitted retaining adapter 109.

Figure 4:
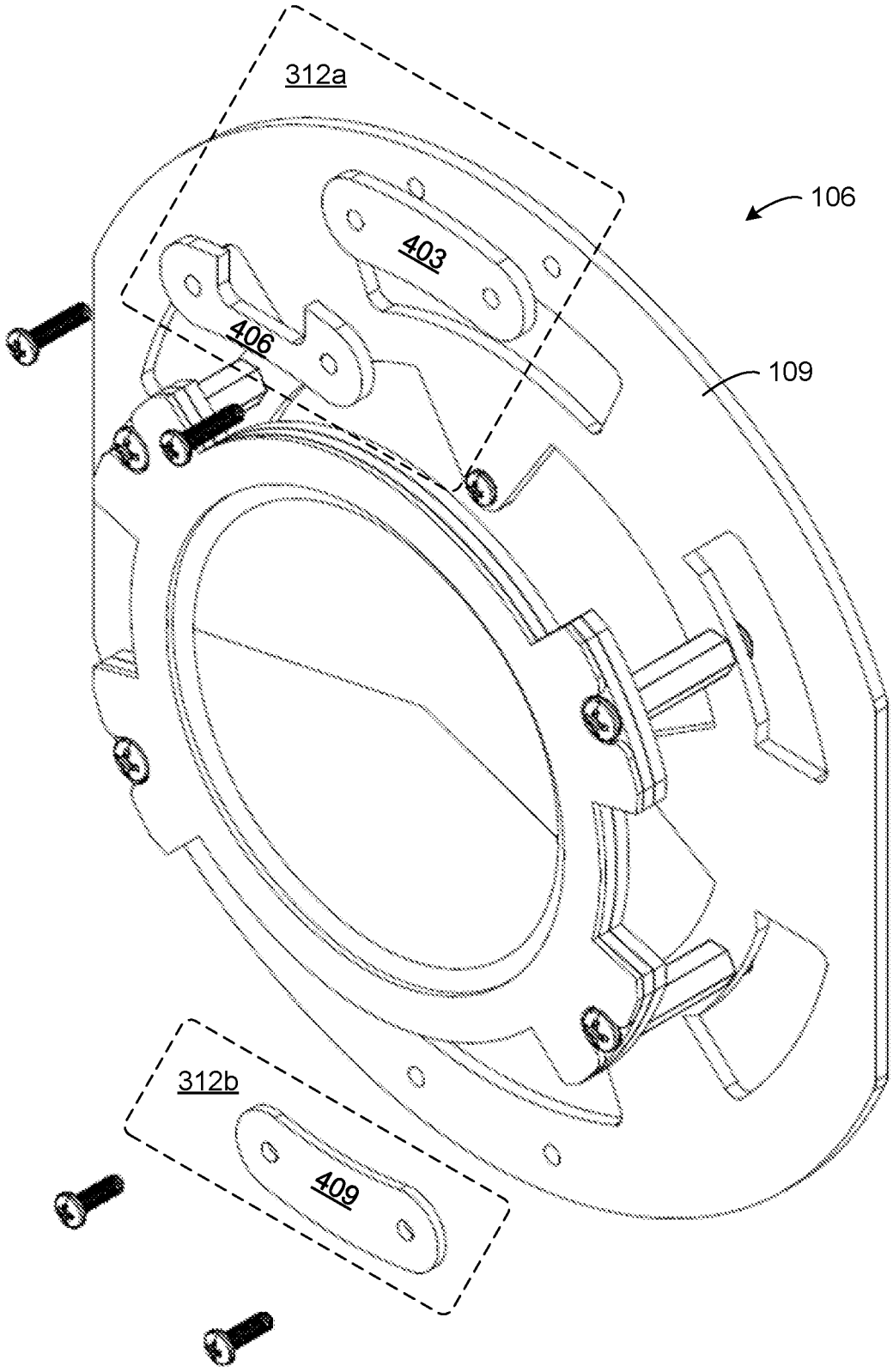
FIGS. 4 and 5 are drawings that illustrate explosion isometric views of the lens-fitting retrofit assembly, according to various embodiments of the present disclosure.

FIG. 4 shows an explosion isometric view of the lens-fitted retrofit assembly 106. In this figure, the example multi-layer lens retaining protrusions 312*a* and 312*b* are shown exploded. The lens retaining protrusion 312*a* includes rotation stops that prevent the lens-fitted retaining adapter from rotating away from the matching lens holding elements. In this example, the lens retaining protrusion 312*a* includes two layers. A first layer 403 provides a thickness that matches a thickness of an edge of an original lens, or a thickness that matches the lens holding element. A second notched layer 406 provides a notch that matches or is at least as large as the lens holding element of the original fixture 121.

The notch can be sized to accept a lens holding clip and/or a lens holding ridge, and can prevent rotation of the lens-fitted retrofit assembly. The two layers can be held to the lens-fitted retaining adapter 109 using one or more of screws, rivets, epoxy, glue or another attachment. In other cases, a lens retaining protrusion 312*a* can be a single component that forms a three dimensional shape approximating a combination of the two layers shown. For example, the single component version can include a notched, or a humped and notched, protrusion that can be incorporated into or attached to an otherwise flat lens-fitted retaining adapter 109. The lens-fitted retaining adapter 109 can include molded, machined, or solid injection-molded assemblies that can incorporate the lens retaining protrusions 312 into an integrated component of the lens-fitted retaining adapters 109 or attach the lens retaining protrusions 312 as separate components attached to the lens-fitted retaining adapters 109.

The lens retaining protrusion 312*b* includes a single layer 409 that matches the lens holding element of the original fixture 121. In this example, the rivets, bolts, or other mechanical attachments between the lens retaining protrusion 312*b* and the lens-fitted retaining adapter 109 can form rotation stops of the lens retaining protrusion.

Figure 5:
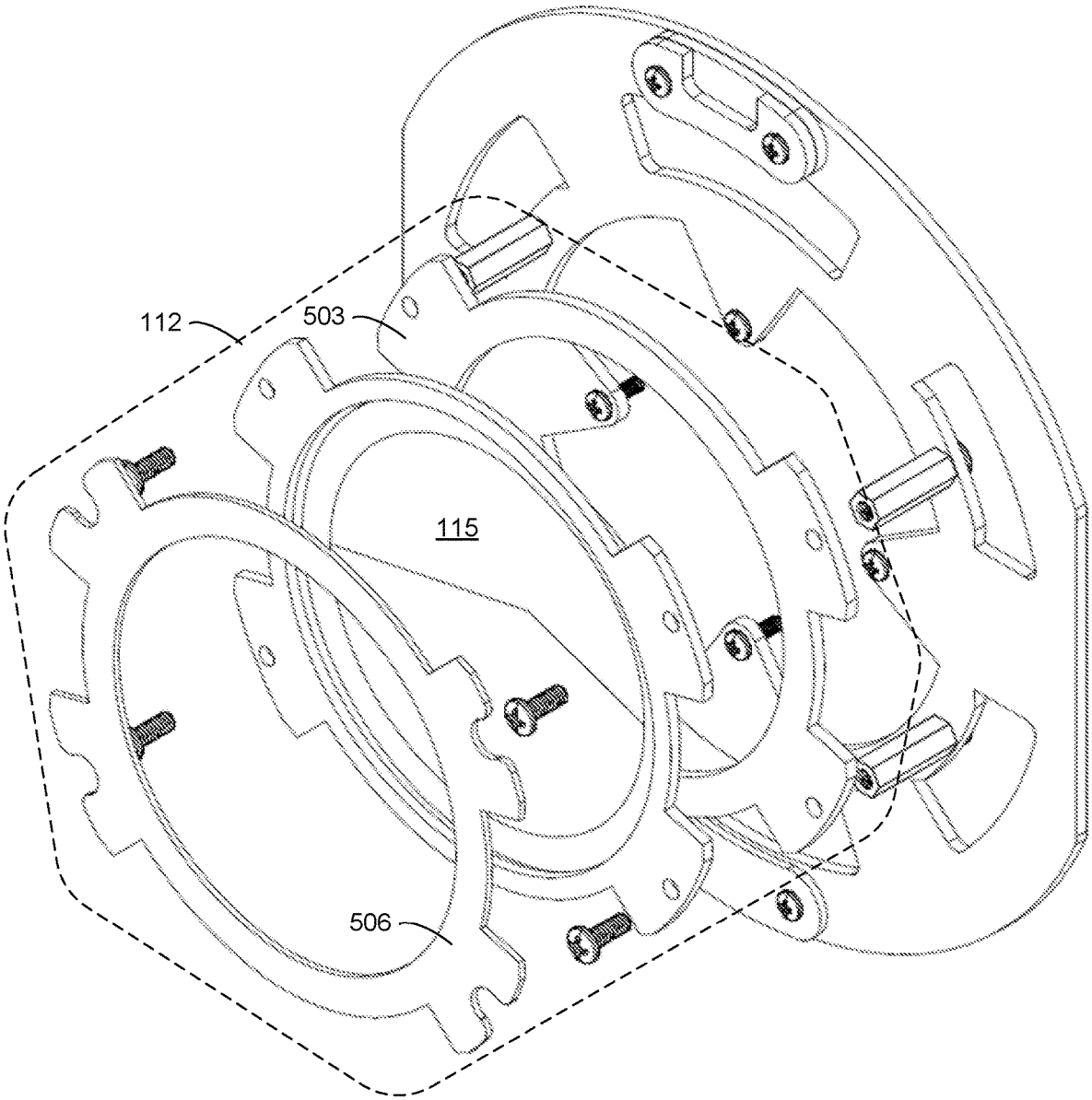

FIG. 5 shows another exploded isometric view of the lens-fitted retrofit assembly 106. In this figure, the accessory retainer 112 is shown exploded. The accessory retainer 112 can include magnetic or mechanical retaining elements that securely accept an accessory 115 and hold it against a retaining backplate 503 of the accessory retainer 112. For example, a magnetic accessory retainer 112 can include a magnetic or ferromagnetic metal backplate 503 that magnetically holds to a magnetic or ferromagnetic metal front-plate 506. In other cases, a mechanical accessory retainer 112 can include a mechanically connected backplate 503 that mechanically connects to a front-plate 506. IN the example shown the front-plate 506 can be a magnetic front-plate that includes screw cutouts that allow the back-plate screws to be accessed without removing the front-plate 506.

The accessory retainer 112 of the lens-fitted retrofit assembly 106 can hold an accessory 115 such as a lens, gel, or light-shaping diffusion that substantially matches the original fixture light configuration, including the lens gel, and diffusion. In other cases, the lens-fitted retrofit assembly 106 can be configured with any desirable configuration. Since the original lens cannot be used when the lens-fitted retrofit assembly is held by the original lens holder, it can be desirable in some examples to include an accessory retainer in order to maintain the option of using a lens along with the LED lamp engine 103. The LED engine and accessory-holder held lens can be design to match or approximate light output measurements including the throw, intensity, lux, beam angle, field angle, beam width, field width, and other light output measurements of the original light fixture's light source and lens combination. A lens-fitted retrofit assembly 106 can also be referred to as lens-matching.

Figure 6:
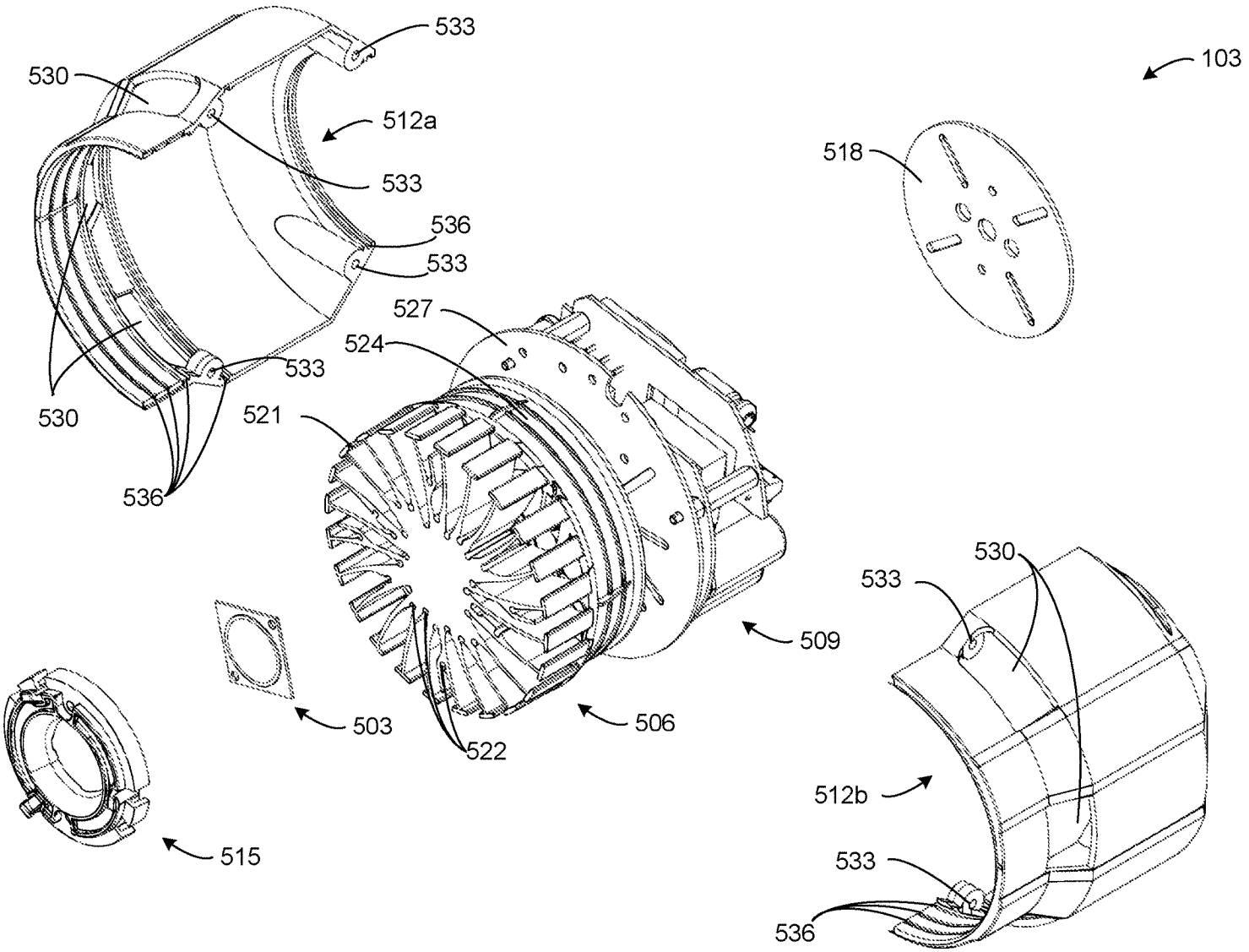
FIG. 6 is a drawing that illustrates an explosion view of an LED lamp engine of the retrofit LED lamp system, according to various embodiments of the present disclosure.

FIG. 6 shows an explosion view of an LED lamp engine 103 of the retrofit LED lamp system 100. The LED lamp engine 103 can include a light-emitting diode (LED) unit 503, a heat dissipation assembly 506, an LED driver assembly 509, a casing assembly 512 that includes a first longitudinal section 512*a* and a second longitudinal section 512*b*. The LED lamp engine 103 can also include an optics assembly 515, and an electrical connection mounting plate 118. The LED lamp engine 103 can be configured as equivalent or approximate lighting provided by a number of different traditional Tungsten wattages, such as 300 Watts, 500 Watts, 700 Watts, 1000 Watts, and other wattages above and below these values. For example, the LED lamp engine 103 itself can use decreased wattage levels such as 17 Watts, 30 Watts, 49 Watts, 72 Watts, 94 Watts, and other wattages above and below these values in order to match or approximate the original lighting provided by a number of different traditional Tungsten wattages of the original light fixture.

The LED unit 503 can be a high-power single point source emulated LED chip or chip-on-board (COB) LED unit. A single LED unit 503 can include a single LED or multiple LEDs, for example, in an array of LEDs. The LED unit 503 can also include a lens or optical refractors. In other cases, a lens or optical reflector is not part of the LED unit 503. The optics assembly 515 can include external lenses, reflectors, and other components. As shown, the optics assembly 515 can be an optics holder. In some cases, the optics assembly 115 can be coupled to an anterior portion of the heat dissipation assembly 506, and can secure or hold the LED unit 503. In some examples, the LED unit 503 can be held within a recessed portion of the heat dissipation assembly. The optics assembly 515 can also include a light reflector coupled to an anterior portion of the shown optics holder.

The heat dissipation assembly 506 can include passive and/or active elements. For example, the heat dissipation assembly can include a heat sink 521 and a fan assembly 524. The heat sink 521 can include a plurality of attachment points 522, which can include threaded holes, or holes for an interference fit or another engineering fit.

The fan assembly 524 can have a fan and a fan casing with an external shape with a number of ridges around its periphery, which can be substantially circular. The fan casing can also have a number of longitudinal ridges perpendicular to the substantially circular ridges. The casing assembly 512 can have an internal shape that matches the external shape of the fan assembly 524. For example, the casing assembly 512 can include a number of slots or indents 536 that accept the ridges of the fan casing to hold the heat sink assembly 506 when the longitudinal halves 512*a* and 512*b* are adjacently secured around the fan casing.

The LED unit 503, heat dissipation assembly 506, and optics assembly 515 can be referred to as an LED engine 103. The LED engine 103 can be secured a fixed distance from the LED driver assembly 527 by the casing assembly 512, for example, by securing the longitudinal halves of the casing assembly 512 around the respective parts. In some cases, the heat dissipation assembly 506 can also include a heat dissipation mounting plate, for example, posterior to the other components of the heat dissipation assembly 506 including the fan and/or the heat sink. The LED engine can be secured a fixed distance from the LED driver assembly 527 by the casing assembly 512, for example, by securing the slots or indents 536 of the longitudinal halves of the casing assembly 512 around the heat dissipation mounting plate and the LED driver mounting plate 527. The LED unit 503, once assembled in the LED engine 103, can be held in front of, or within, the recess shown in the heat sink 521.

The LED driver assembly 509 can include modular circuit boards and may include LED dimmer circuitry, and the like. The LED driver is in operable communication with the LED light engine. The LED driver assembly 509 can also include an LED driver mounting plate 527. The LED driver mounting plate 527 can be substantially circular and planar and can be held can be held by the casing assembly 512 in a slot or indent 536 formed by the longitudinal halves 512*a* and 512*b* when the longitudinal halves 512*a* and 512*b* are adjacently secured. At least a portion of an outer circumference of the LED driver mounting plate 527 can be curved with a particular radius of curvature. The LED driver assembly 509 can be held a fixed distance from the heat dissipation assembly 506 in this way.

The electrical connection mounting plate 518 can be substantially circular and planar and can be held posterior to the LED driver assembly 509 by the casing assembly 512 by a slot or indent 536 when the longitudinal halves 512*a* and 512*b* are adjacently secured. The electrical connection mounting plate 518 can include a plurality of mounting holes that can be used to mount electrical power connections including the screw bases, prong bases, bayonet bases or wiring ends described above. The mounting holes can include circular holes and elongate holes or slots that can provide a variable positioning for bolts and screws. In some cases, the mounting holes can be threaded.

The casing assembly 512 can include casing ventilation holes 530 and casing attachment holes 533 on each of the longitudinal halves 512*a* and 512*b*. In some examples, the casing attachment holes 533 can be threaded. The casing assembly 512 can be made of plastic, such as phenolic plastic. This can provide strength and versatility, as well as prevent heat transfer, for example, between the LED driver assembly 509 and the heat dissipation assembly 506. Metals and other materials can also be used. The casing ventilation holes 530 can vent heat away from both the heat dissipation assembly 506 as well as the LED driver assembly 509. The ventilation holes 530 can be provided between the LED driver assembly 109 and the heat dissipation assembly 506.

The casing assembly 512 can provide an engineering fit around the heat dissipation mounting plate and/or other portion of the heat dissipation assembly 506, the LED driver mounting plate 527 or other portion of the LED driver assembly 506, and the electrical connection mounting plate 518. The casing assembly 512 can do so by providing a slot or indent 536 for each of the components. Engineering fit can refer to any of a clearance fit where the slot or other hole of the casing assembly is larger than the object held therein, a location fit or transition fit where the hole is equal to or slightly smaller than the object held therein (e.g., tight fit, similar fit, fixed fit), or and interference fit, where the hole is smaller than the object held therein.

Additional details of the LED lamp system can be found in PCT Application No. PCT/US18/55835, filed on Oct. 15, 2018, which is incorporated herein by reference in its entirety.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

The invention claimed is:

1. An LED lamp system that retrofits into a light fixture, comprising:

an LED lamp engine;

a lens-fitted retrofit assembly attached anterior to the LED lamp engine; and a lens-fitted retaining adapter of the lens-fitted retrofit assembly, the lens-fitted retaining adapter comprising an anterior-facing protrusion comprising a notch that secures the lens-fitted retaining adapter aligned in place relative to a lens holding clip of a lens holder of the light fixture, and wherein the LED lamp system is held into the light fixture based at least in part on the lens-fitted retaining adapter and the lens holder.

2. The LED lamp system of claim 1, wherein the lens holder comprises a lens-shaped recess.

3. The LED lamp system of claim 1, wherein the lens-fitted retrofit assembly further comprises an accessory retainer.

4. The LED lamp system of claim 3, wherein the accessory retainer comprises a magnetic or ferromagnetic metal backplate that magnetically holds a magnetic or ferromagnetic metal front-plate.

5. The LED lamp system of claim 3, wherein the accessory retainer holds at least one of: a lens, a light-shaping diffusion film, a holographic diffusion film, and a color filter.

6. The LED lamp system of claim 3, wherein the accessory retainer attaches anterior to the lens-fitted retaining adapter.

7. The LED lamp system of claim 1, further comprising a base socket adapter that electrically connects the LED lamp engine to an electrical power output of the light fixture.

8. An LED lamp system that retrofits into a PAR lighting fixture, comprising:

an LED lamp engine comprising at least one LED light source;

a lens-fitted retaining adapter that secures the LED lamp engine to a lens holder of the PAR lighting fixture, wherein the lens-fitted retaining adapter comprises an anterior-facing protrusion that forms a notch that secures the lens-fitted retaining adapter aligned in place relative to a lens holding element of the lens holder;

a total internal reflection (TIR) lens assembly attached anterior to the lens-fitted retaining adapter; and an accessory retainer anterior to the TIR lens assembly.

9. The LED lamp system of claim 8, wherein the TIR lens assembly comprises a TIR lens and a connecting component that connects the TIR lens to the lens-fitted retaining adapter.

10. The LED lamp system of claim 8, wherein the accessory retainer comprises a magnetic accessory retainer that magnetically holds an accessory of the LED lamp system between the magnetic accessory retainer and the TIR lens assembly.

11. The LED lamp system of claim 8, wherein the accessory retainer comprises a spring accessory retainer that holds an accessory of the LED lamp system to the TIR lens assembly.

12. The LED lamp system of claim 8, wherein the accessory retainer holds an accessory comprising at least one of: a color filter, a beam shaping film, a diffusion film, and a holographic diffuser film.

13. The LED lamp system of claim 8, wherein the notch of the protrusion of the lens-fitted retaining adapter secures the LED lamp engine to a spring locking lens retainer clip comprising the lens holding element of the lens holder of the PAR lighting fixture.

14. The LED lamp system of claim 8, further comprising:

a lamp socket adapter that electrically connects the LED lamp engine to an original lamp socket of the PAR lighting fixture.

15. The LED lamp system of claim 8, further comprising:

a custom lamp cap that connects to a posterior of the PAR lighting fixture in place of an original lamp cap of the PAR lighting fixture, the custom lamp cap comprising a lamp socket that differs from an original lamp socket of the original lamp cap; and a lamp socket adapter that electrically connects the LED lamp engine to the custom lamp cap.

16. A method for retrofitting a light fixture, the method comprising:

removing a lens from a lens holder of the light fixture;

attaching an LED engine to a lens-fitted retrofit assembly;

attaching the lens-fitted retrofit assembly to the light fixture by inserting the lens-fitted retrofit assembly into the lens holder, the lens-fitted retrofit assembly comprising a lens-fitted retaining adapter comprising anterior-facing rotation stops that secure the lens-fitted retaining adapter in place relative to a lens holding element of the lens holder; and electrically connecting the LED engine to a lamp base of a back cap that is coupled to the light fixture, the LED engine being connected to the lamp base using a lamp base adapter comprising a lamp base connector that matches the lamp base and an LED engine connector that matches an electrical connection of the LED engine.

17. The method of claim 16, further comprising:

removing a light source from the back cap, wherein the back cap is an original back cap of the light fixture.

18. The method of claim 16, further comprising:

replacing an original back cap of the light fixture with the back cap, wherein the back cap is a custom back cap that connects to a posterior of the light fixture in place of an original lamp cap of the light fixture, the custom back cap comprising a lamp socket that differs from an original lamp socket of the original back cap.

19. The method of claim 16, wherein the lens-fitted retrofit assembly further comprises an accessory retainer.

20. The method of claim 19, further comprising:

holding an accessory using the accessory retainer, the accessory comprising at least one of: a color filter, a beam shaping film, a diffusion film, and a holographic diffuser film.

* * * * *